US005267372A

United States Patent [19]

Jones

[11] Patent Number: 5,267,372

[45] Date of Patent: Dec. 7, 1993

[54] HAIR VACUUM APPARATUS

[76] Inventor: Gale M. Jones, P.O. Box 505, Beaufort, N.C. 28516

[21] Appl. No.: 872,846

[22] Filed: Apr. 23, 1992

[51] Int. Cl.[5] ..... A47L 5/24

[52] U.S. Cl. ..... 15/344; 15/415.1; 15/422

[58] Field of Search ..... 15/344, 422, 415.1

[56] References Cited

U.S. PATENT DOCUMENTS

| | | | |
|---|---|---|---|
| 1,994,869 | 3/1935 | Replogle | 15/422 |
| 2,668,315 | 2/1954 | Crosby | 15/344 |
| 2,753,434 | 7/1956 | Storm | 15/344 X |
| 2,758,330 | 8/1956 | Sloan | 15/344 |
| 2,972,160 | 2/1961 | Hahn | 15/344 |
| 4,218,806 | 8/1980 | Cohn | 15/344 X |
| 4,279,095 | 7/1981 | Aasen | 15/402 X |
| 4,553,284 | 11/1985 | Strumbos | 15/414 |
| 4,799,460 | 1/1989 | Kuhl | 15/344 |
| 5,074,006 | 12/1991 | Eremita | 15/344 |

FOREIGN PATENT DOCUMENTS

| | | | |
|---|---|---|---|
| 631615 | 11/1961 | Canada | 15/344 |
| 394527 | 11/1965 | Switzerland | 15/344 |
| 308457 | 4/1929 | United Kingdom | 15/344 |
| 717578 | 10/1954 | United Kingdom | 15/344 |

*Primary Examiner*—Chris K. Moore
*Attorney, Agent, or Firm*—Leon Gilden

[57] ABSTRACT

An apparatus is directed to permit individuals to remove debris and the like entrapped within an individual's hair, with the apparatus having an elongated truncated conical body flaring outwardly from a handle portion obliquely relative to the handle portion, and the body having an entrance opening formed with an entrance screen to prevent air from being directed into the vacuum. A removable filter is positioned between the vacuum motor and a rear distal end of the body. A modification of the invention includes an encircling clamp mounted about the body, with the body formed of a shape retentent material permitting deformation of the entrance opening to accommodate various portions of an individual's head and geometric variations thereof.

8 Claims, 4 Drawing Sheets

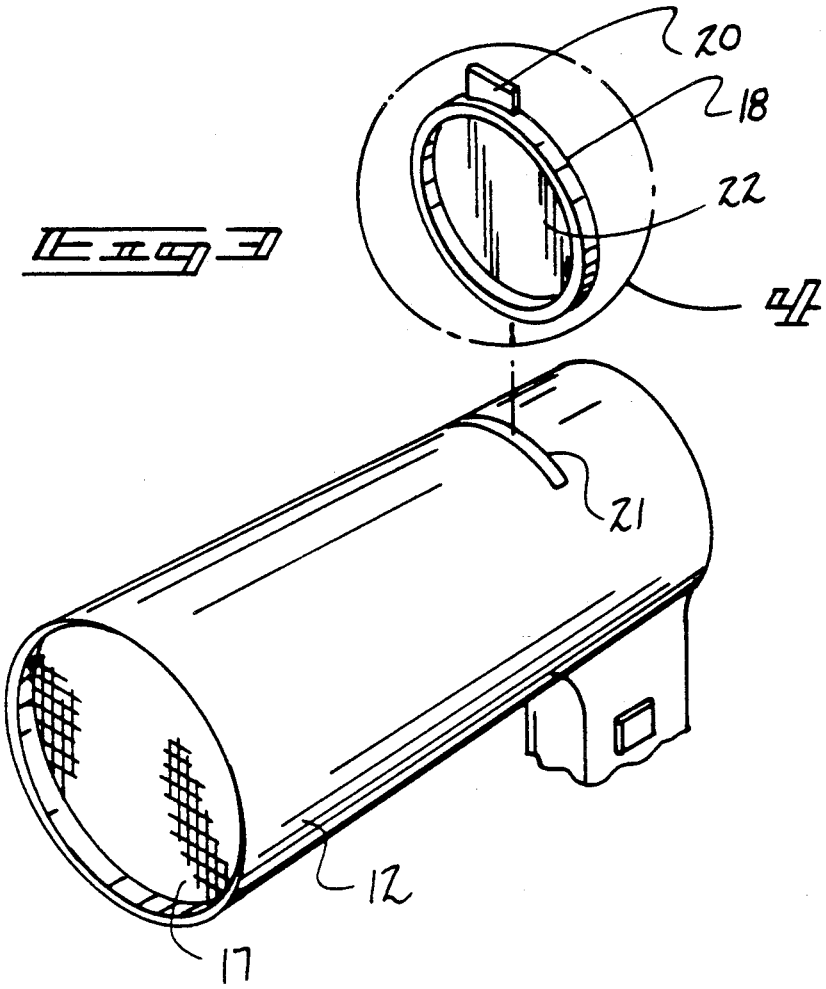
FIG 3
FIG 4
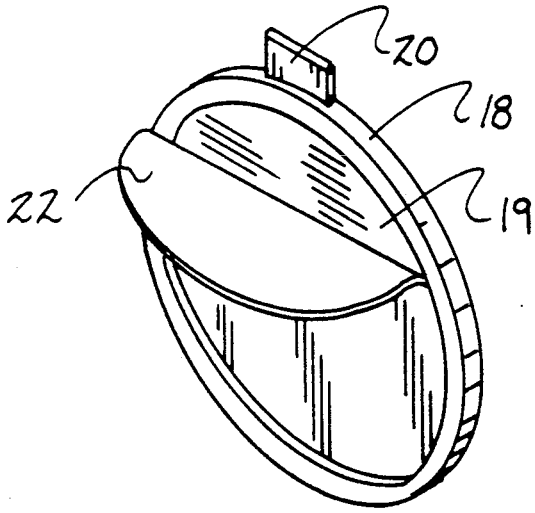

8
10a
21
14
32
31
30
23
11
15
8

9
25
31
29
30
26
9

28
31
29
30
27

HAIR VACUUM APPARATUS

BACKGROUND OF THE INVENTION

1. Field of the Invention

The field of invention relates to vacuum apparatus, and more particularly pertains to a new and improved hair vacuum apparatus wherein the same is arranged to remove debris from an individual's hair.

2. Description of the Prior Art

Brushing alone in hair grooming does not remove various particles from an individual's hair, and the instant invention addresses a vacuum apparatus directed specifically to the vacuuming of such debris, such as dandruff and the like.

Various vacuum structure associated with hair is set forth in U.S. Pat. No. 3,613,237 to Keane setting forth a vacuum assembly for use with a hair cutting arrangement.

U.S. Pat. No. 4,218,806 to Cohn sets forth a vacuum for hair utilizing a vacuum motor positioned rearwardly of an entrance screen.

U.S. Pat. No. 3,929,142 to Carfi sets forth a hair vacuum with a stripping clasp to permit hair to pass through the clasp and the vacuum head.

U.S. Pat. No. 4,706,326 to Romani sets forth a hair vacuum and dryer organization permitting selective vacuuming and blow drying of hair.

As such, it may be appreciated that there continues to be a need for a new and improved hair vacuum apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hair vacuum apparatus now present in the prior art, the present invention provides a hair vacuum apparatus wherein the same is arranged to remove particles relative to an individual's hair. As such, the general purpose of the present invention, which will be described subsequently in greater detail, is to provide a new and improved hair vacuum apparatus which has all the advantages of the prior art hair vacuum apparatus and none of the disadvantages.

To attain this, the present invention provides an apparatus directed to permit individuals to remove debris and the like entrapped within an individual's hair, with the apparatus having an elongated truncated conical body flaring outwardly from a handle portion obliquely relative to the handle portion, and the body having an entrance opening formed with an entrance screen to prevent air from being directed into the vacuum. A removable filter is positioned between the vacuum motor and a rear distal end of the body. A modification of the invention includes an encircling clamp mounted about the body, with the body formed of a shape retentent material permitting deformation of the entrance opening to accommodate various portions of an individual's head and geometic variations thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair vacuum apparatus which has all the advantages of the prior art hair vacuum apparatus and none of the disadvantages.

It is another object of the present invention to provide a new and improved hair vacuum apparatus which may be easily and efficiently manufactured and marketed.

It is a further object of the present invention to provide a new and improved hair vacuum apparatus which is of a durable and reliable construction.

An even further object of the present invention is to provide a new and improved hair vacuum apparatus which is susceptible of a low cost of manufacture with regard to both materials and labor, and which accordingly is then susceptible of low prices of sale to the consuming public, thereby making such hair vacuum apparatus economically available to the buying public.

Still yet another object of the present invention is to provide a new and improved hair vacuum apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the invention.

FIG. 4 is an isometric illustration of section 4 as set forth in FIG. 3, illustrating the forward web partially removed relative to the screen.

DESCRIPTION OF THE PREFERRED EMBODIMENT

Figure 1:
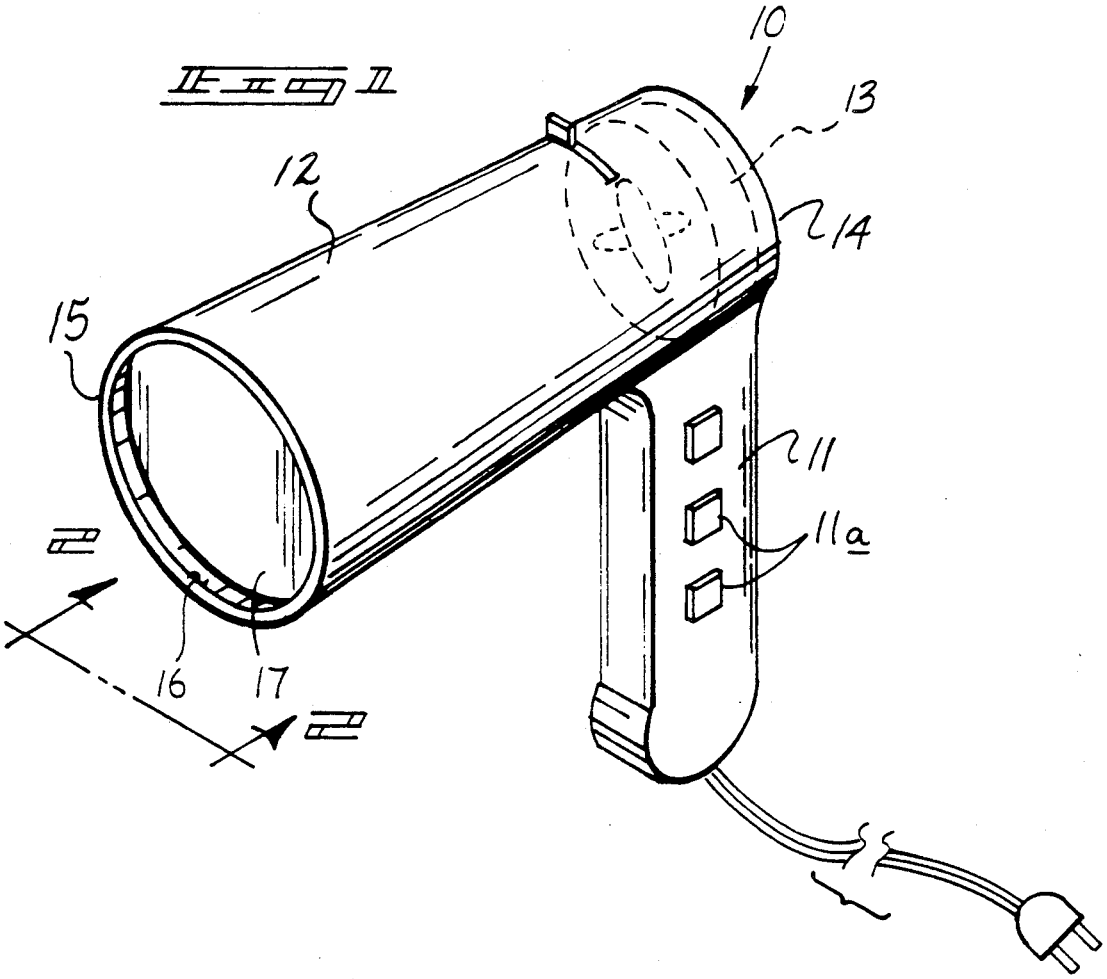
FIG. 1 is an isometric illustration of the instant invention.
Figure 2:
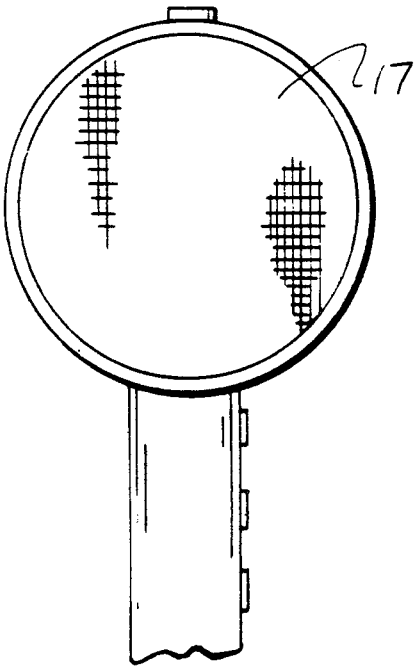
FIG. 2 is an orthographic view, taken along the lines 2—2 of FIG. 1 in the direction indicated by the arrows.

With reference now to the drawings, and in particular to FIGS. 1 to 9 thereof, a new and improved hair vacuum apparatus embodying the principles and concepts of the present invention and generally designated by the reference numerals 10 and 10*a* will be described.

Figure 5:
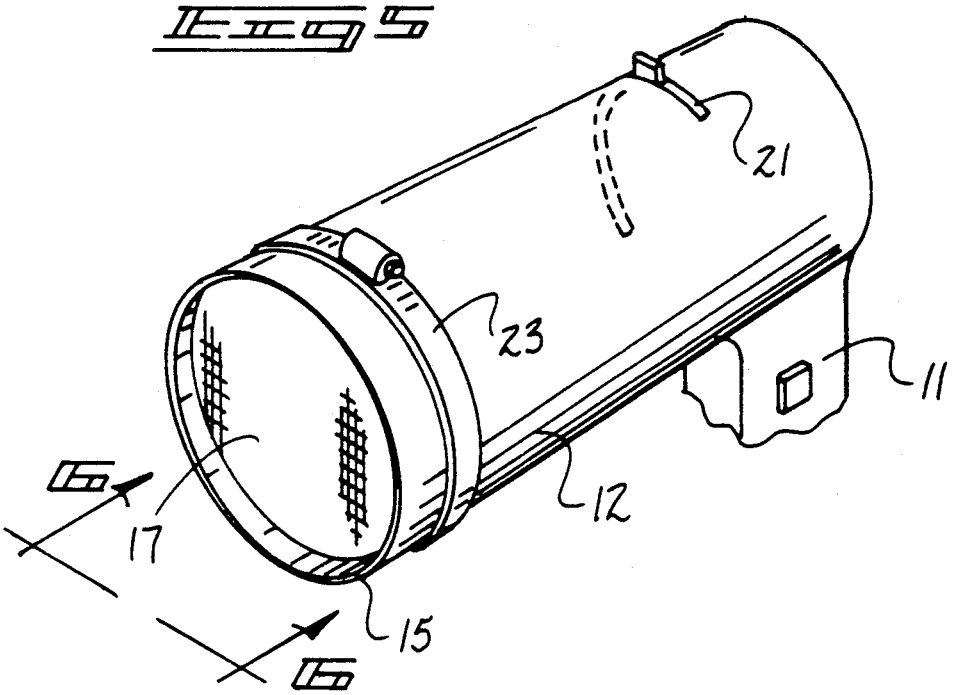
FIG. 5 is an isometric illustration of the forming clamp utilized in association with the vacuum body.
Figure 6:
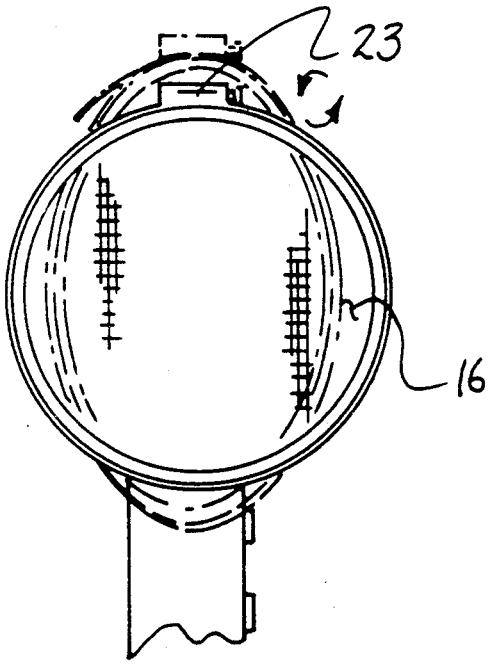
FIG. 6 is an orthographic view, taken along the lines 6—6 of FIG. 5 in the direction indicated by the arrows.

More specifically, the hair vacuum apparatus 10 of the instant invention essentially comprises a handle 11 having handle motor controls mounted thereon to effect operation of a vacuum motor 13 mounted within a truncated conical body 12 adjacent a rear distal end 14 of the truncated conical body, with the truncated conical body flaring outwardly to a forward distal end 15 having a forward end entrance opening 16. A mesh screen 17 is mounted within the truncated conical body adjacent the forward distal end and more specifically the forward entrance opening 16 to prevent hair from being directed into the body 12, as well as trapping various particles thereon. Should such particles be directed through the mesh screen 17, a filter disc 18 removably mounted within the body through a semi-cylindrical slot 21 is provided. The filter disc 18 (as illustrated in the FIGS. 3 and 4) has a cylindrical framework formed with a disc tab web 20 projecting exteriorly of the semi-cylindrical slot 21. A bactericide saturated web 22 formed of porous material is mounted coextensively over the filter screen 19 for preventing germicidal particles from being directed through the filter disc 18 and the rear distal end 14 exhausting air therefrom. Such vacuum motor apparatus 13 per se is of conventional construction, such as typified in the U.S. Pat. No. 4,218,806 incorporated herein by reference. The FIGS. 5 and 6 illustrate the apparatus having a circular clamp 23 mounted surroundingly about the body 12 adjacent the forward entrance opening 16. The body 12 is formed of a deformable shape retentent material and whereupon tightening of the circular clamp 23 effects deformation of the entrance opening to accommodate various configurations of an individual's head in use.

Figure 7:
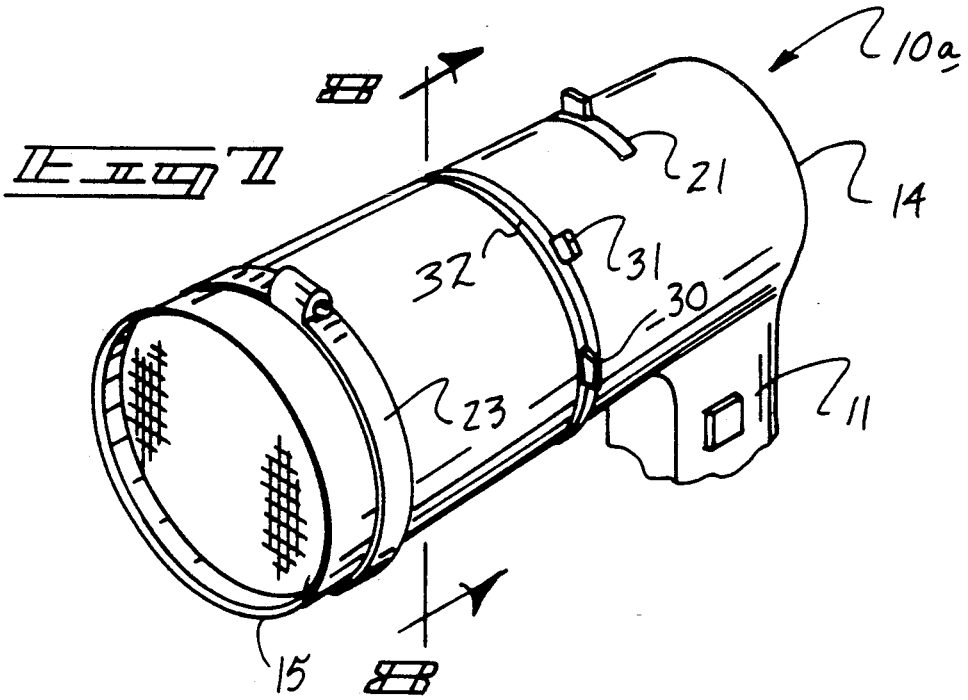
FIG. 7 is an isometric illustration of a modification of the invention.
Figure 8:
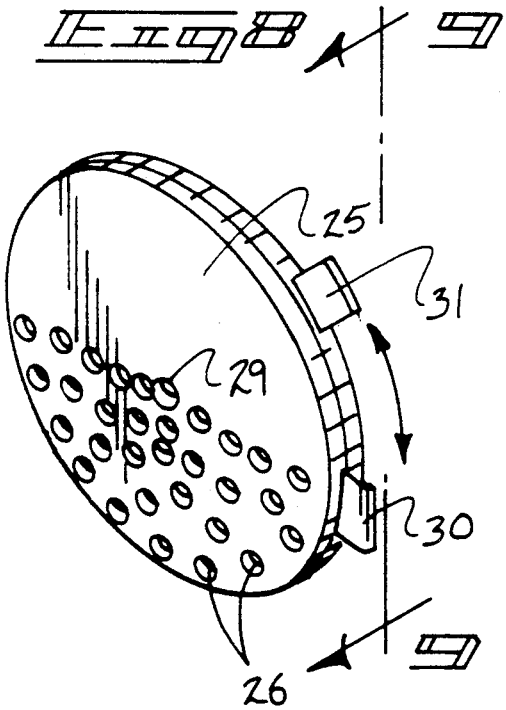
FIG. 8 is an isometric illustration, taken along the lines 8—8 of FIG. 7 in the direction indicated by the arrows.
Figure 9:
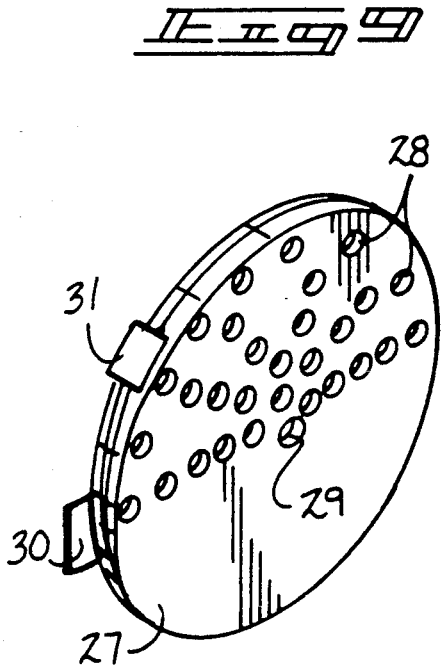
FIG. 9 is an isometric illustration, taken along the lines 9—9 of FIG. 8 in the direction indicated by the arrows.

The apparatus 10*a*, as illustrated in the FIGS. 7-9, further includes a first cylindrical disc 25 rotatably mounted relative to a second cylindrical disc 27, with the disc received through semi-cylindrical slot 32 between the semi-cylindrical slot 21 and the circular clamp 23. The first cylindrical disc 25 has a matrix of first disc apertures 26 directed through a lower semi-cylindrical portion of the first disc 25, with the second cylindrical disc 27 having a matrix of second disc apertures 28 directed through an upper semi-cylindrical portion of the second semi-cylindrical disc, whereupon the first disc has a first disc handle 30 projecting above the second semi-cylindrical slot 32, with the second disc having a second disc handle 31 projecting above the semi-cylindrical slot 32 permitting selective relative rotation of the first disc relative to the second disc to align or displace the first and second apertures 26 and 28 relative to one another to meter air flow and vacuum intensity through the body 12 in use. The discs are in contiguous coextensive relationship relative to one another rotatably mounted relative to one another about a disc axle 29 coaxially directed through the first and second discs.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair vacuum apparatus, comprising, a handle and a truncated conical body, the handle obliquely and integrally mounted to the conical body, with the handle intersecting the conical body adjacent a body rear distal end, the body having a body forward distal end having a forward entrance opening, and the body having a semi-cylindrical slot directed through the body, with a filter disc removably mounted in the body through the semi-cylindrical slot, and a vacuum motor mounted within the body between the filter disc and the rear distal end, and a filter screen mounted within the body adjacent the entrance opening.

2. An apparatus as set forth in claim 1 wherein the filter disc includes a cylindrical framework having a filter screen mounted coextensively therewithin, and the disc having a disc top web directed through the semi-cylindrical slot exteriorly of the body to permit ease of removal of the disc relative to the body.

3. An apparatus as set forth in claim 2 wherein the disc includes a bactericide saturated porous web mounted coextensively over the filter screen.

4. An apparatus as set forth in claim 3 wherein the cylindrical body is formed of a deformable shape-retentive material, with a circular clamp mounted about the body adjacent the entrance opening permitting deformation of the entrance opening upon tensioning of the circular clamp.

5. An apparatus as set forth in claim 4 including a second semi-cylindrical slot directed through the body between the semi-cylindrical slot and the entrance opening, and the body including a first cylindrical disc rotatably mounted relative to a second cylindrical disc directed into the body through the second semi-cylindrical slot, the first cylindrical disc and the second cylindrical disc rotatably mounted relative to one another about a disc axle coaxially directed through the first disc and the second disc.

6. An apparatus as set forth in claim 5 wherein the entrance opening, the first disc, the second disc, and the filter disc are coaxially aligned relative to one another.

7. An apparatus as set forth in claim 6 wherein the first disc includes a semi-cylindrical matrix of apertures directed through an upper semi-cylindrical portion of the first disc, and the second disc having a matrix of second apertures directed through the semi-cylindrical disc through a lower semi-cylindrical portion of the second disc, wherein the first disc and the second disc are rotatable relative to one another to effect selective alignment of the first apertures and the second apertures for metering of air flow directed through the body.

8. An apparatus as set forth in claim 7 wherein a first disc includes a first disc handle projecting exteriorly of the second cylindrical slot and the second disc includes a second disc handle directed through the second cylindrical slot to permit ease of manual grasping of the first disc handle and the second disc handle for rotation of the first disc relative to the second disc.

* * * * *